United States Patent [19]

Colk

[11] 3,943,921

[45] Mar. 16, 1976

[54] VIBRATOR BATH AND CLEANER

[75] Inventor: Carl F. G. Colk, Duncan, Canada

[73] Assignee: The Raymond Lee Organization, Inc., New York, N.Y.

[22] Filed: Mar. 11, 1975

[21] Appl. No.: 557,278

[52] U.S. Cl. ..... 128/62 R; 128/65; 401/4; 4/184; 15/110;

[51] Int. Cl.[2] ..... A61H 7/00; A61H 9/00; A47L/13/12

[58] Field of Search ..... 128/62, 65, 67, 32, 24.1, 128/24.2; 401/4; 4/184; 15/110

[56] References Cited

UNITED STATES PATENTS

| | | | |
|---|---|---|---|
| 1,047,729 | 12/1912 | Beardsley | 401/4 |
| 2,513,772 | 7/1950 | Amer | 128/67 |
| 2,526,190 | 10/1950 | Alvarez | 128/24.1 |
| 3,055,040 | 9/1962 | Schemerhorn | 401/4 X |
| 3,234,933 | 2/1966 | Martin | 128/65 |

*Primary Examiner*—Lawrence W. Trapp
*Attorney, Agent, or Firm*—Stephen Wyden

[57] ABSTRACT

A bar of soap inside a sponge is vibrated by motor and battery in the handle of a vibrator and a scratcher is formed by the front of the vibrator.

1 Claim, 2 Drawing Figures

VIBRATOR BATH AND CLEANER

I have invented a new and novel machine for massaging and cleaning at the same time. It can be understood in view of the accompanying figures.

Figure 1:
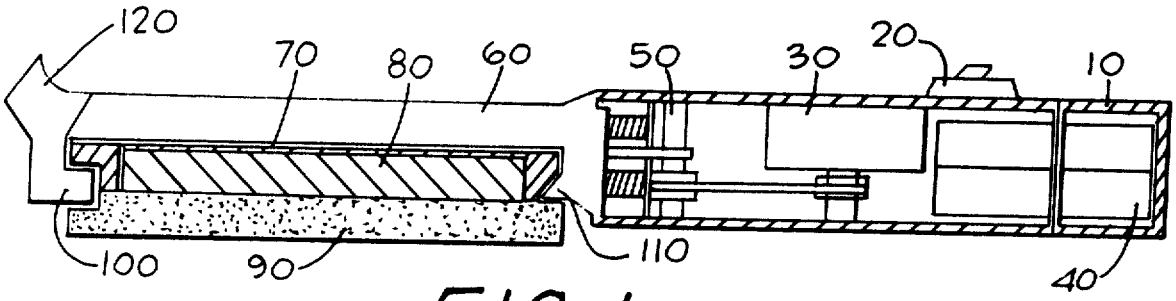
FIG. 1 is a side view of the vibrator showing details of its construction.

In FIG. 1, the vibrator case 10 has mounted on it a switch 20 which electrically activates a motor 30 powered by batteries 40 to drive a vibrator mechanism 50 which converts the rotating motion produced by the motor into reciprocal action which causes the front section 60 to vibrate. The front section has a receptacle 70 for holder comprising a bar of soap 80 retained by the holder and a sponge 90 held in the receptacle 70 by a front 100 and mounted on the face of the holder a rear 110 clip. A scratcher is formed by the front end of the front section.

Figure 2:
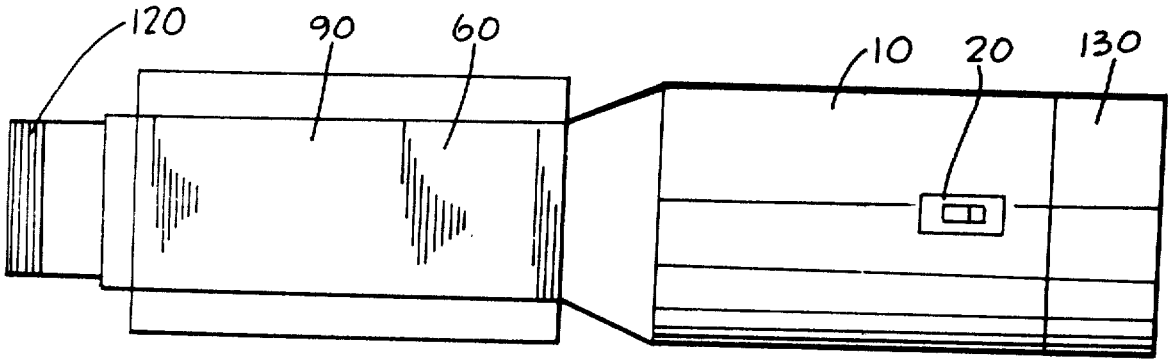
FIG. 2 is a top view of the vibrator showing its external appearance.

In FIG. 2, the vibrator case 10 has a switch mounted on the upper surface 20 and the removable cap 130 for changing the batteries is visible. The front section 60 and the sponge 90, and the scratcher 120 are also visible.

Having described a preferred embodiment of my invention, it is understood that various changes can be made without departing from the spirit of my invention, and, I desire to cover by the appended claims all such modifications as fall within the true spirit and scope of my invention.

What I claim and seek to secure by Letters Patent is:

1. A vibrator bath and cleaner, comprising:

a case, a battery mounted in the case, a switch mounted on the case, electrically connected to the battery, a motor mounted in the case, electrically connected to the switch, a vibrator mechanism mounted in the case, driven by the motor, a front section attached to the case and vibrated by the vibrator mechanism, the front of the front section forming a scratcher, retaining means formed in the front section to hold a holder, and the holder comprising a retainer for a bar of soap and a sponge mounted on the face of the holder.

* * * * *